US008976192B2

(12) United States Patent
Huang et al.

(10) Patent No.: US 8,976,192 B2
(45) Date of Patent: Mar. 10, 2015

(54) CONTRAST CONTROL FOR DISPLAY DEVICE

(75) Inventors: Pei-Chen Huang, Tainan County (TW); Yu-Chung Lee, Taoyuan County (TW); Shih-Yu Hsu, Chiayi (TW); Po-Yang Wu, Taichung (TW)

(73) Assignee: Realtek Semiconductor Corp., Hsinchu (TW)

( * ) Notice: Subject to any disclaimer, the term of this patent is extended or adjusted under 35 U.S.C. 154(b) by 866 days.

(21) Appl. No.: 13/178,106

(22) Filed: Jul. 7, 2011

(65) Prior Publication Data

US 2012/0007880 A1 Jan. 12, 2012

Related U.S. Application Data

(60) Provisional application No. 61/362,693, filed on Jul. 9, 2010.

(51) Int. Cl.

| | |
|---|---|
| ***G09G 3/30*** | (2006.01) |
| ***G09G 5/02*** | (2006.01) |
| ***G09G 3/34*** | (2006.01) |

(52) U.S. Cl.

CPC ..... *G09G 3/3406* (2013.01); *G09G 2320/066* (2013.01); *G09G 2360/16* (2013.01)

USPC ..... 345/600; 345/77; 345/589; 345/87

(58) Field of Classification Search

CPC ..... G09G 2320/066; G09G 2320/0666; G09G 2320/0673

USPC ..... 345/600, 589, 77

See application file for complete search history.

(56) References Cited

U.S. PATENT DOCUMENTS

| | | | | |
|---|---|---|---|---|
| 7,053,881 | B2 * | 5/2006 | Itoh | 345/102 |
| 2003/0222884 | A1 * | 12/2003 | Ikeda et al. | 345/589 |
| 2004/0257318 | A1 * | 12/2004 | Itoh | 345/87 |
| 2005/0213125 | A1 * | 9/2005 | Smith et al. | 358/1.9 |
| 2006/0119613 | A1 * | 6/2006 | Kerofsky | 345/590 |
| 2007/0025683 | A1 * | 2/2007 | Nobori | 385/147 |

(Continued)

FOREIGN PATENT DOCUMENTS

| | | |
|---|---|---|
| CN | 1462026 A | 12/2003 |
| CN | 1936676 A | 3/2007 |

(Continued)

*Primary Examiner* — Kent Chang
*Assistant Examiner* — William Lu
(74) *Attorney, Agent, or Firm* — Muncy, Geissler, Olds & Lowe, P.C.

(57) ABSTRACT

A contrast control device is provided. The device of the invention includes a detecting unit, a judging unit, a backlight control unit, a gain generating unit and a contrast gain processing unit. The detecting unit calculates an average value and detects a maximum value of a current image. The judging unit generates a gain index and a brightness index according to the average value. The backlight control unit generates a backlight control signal according to the brightness index. The gain generating unit generates a first contrast gain value and a soft-clamping gain value according to the gain index, the average value and the maximum value and then selects one from the first contrast gain value and the soft-clamping gain value for output as a second contrast gain value according to an input pixel value of the current image. The contrast gain processing unit generates an output pixel value according to the second contrast gain value and the input pixel value.

12 Claims, 7 Drawing Sheets

(56) References Cited

U.S. PATENT DOCUMENTS

| | | | | |
|---|---|---|---|---|
| 2007/0126757 | A1* | 6/2007 | Itoh et al. | 345/690 |
| 2007/0216636 | A1* | 9/2007 | Lo | 345/102 |
| 2008/0024517 | A1* | 1/2008 | Kerofsky | 345/600 |
| 2009/0002285 | A1* | 1/2009 | Baba et al. | 345/77 |
| 2009/0167658 | A1* | 7/2009 | Yamane et al. | 345/89 |
| 2009/0213048 | A1* | 8/2009 | Park et al. | 345/77 |
| 2009/0267876 | A1* | 10/2009 | Kerofsky | 345/87 |
| 2009/0284457 | A1* | 11/2009 | Botzas et al. | 345/102 |
| 2009/0284546 | A1* | 11/2009 | Brown Elliott | 345/596 |
| 2010/0053222 | A1* | 3/2010 | Kerofsky | 345/690 |
| 2011/0043533 | A1* | 2/2011 | Han et al. | 345/589 |
| 2011/0148910 | A1* | 6/2011 | Botzas et al. | 345/600 |

FOREIGN PATENT DOCUMENTS

| | | | |
|---|---|---|---|
| CN | 101241684 | A | 8/2008 |
| CN | 101360182 | A | 2/2009 |
| TW | 200708086 | A | 2/2007 |
| TW | 200813948 | A | 3/2008 |

* cited by examiner

CONTRAST CONTROL FOR DISPLAY DEVICE

This application claims priority from U.S. Provisional Patent Application Ser. No. 61/362,693, filed on Jul. 9, 2010, the content of which is incorporated herein by reference.

BACKGROUND (a) Technical Field

The invention relates to an image display system, particularly to a contrast control device and method thereof.

(b) Description of the Related Art

FIG. 1 shows a block diagram of a conventional image display system. Referring to FIG. 1, a conventional image display device includes a display control portion 102, an average brightness detecting portion 104, a peak detecting portion 106, a liquid crystal display (LCD) portion 108, a backlight control portion 112 and a backlight 110.

The display control portion 102 performs control operations for display on an input image signal (PIC) (e.g. a frame or a field) and supplies an output signal (DRV) to the LCD portion 108. The average brightness detecting portion 104 and the peak detecting portion 106 respectively calculates an average brightness (AVE) value and detects a peak (PEK) value of the PIC signal. According to the AVE value and the PEK value, the backlight control portion 112 adjusts the control signal CTL to control the brightness of the backlight 110. The backlight 110 serves as a light source for providing the brightness to the LCD portion 108.

The conventional image display system only adjusts the brightness of the backlight 110 to reduce power consumption. Therefore, viewers may perceive distorted display images sometimes. Accordingly, what is needed is a device to address the above-identified problems. The invention addresses such a need.

BRIEF SUMMARY

One objective of the invention is to provide a contrast control device that can solve the above problems in the prior art.

One embodiment of the invention provides a contrast control device. The contrast control device comprises: a detecting unit for receiving a current image, calculating an average value and detecting a maximum value of a plurality of pixels of the current image; a judging unit for generating a gain index and a brightness index according to the average value; a backlight control unit for generating a backlight control signal according to the brightness index; a gain generating unit being coupled to the detecting unit for generating a first contrast gain value and a soft-clamping gain value according to the gain index, the average value and the maximum value and for selecting one from the first contrast gain value and the soft-clamping gain value for output as a second contrast gain value according to an input pixel value of the current image; and, a contrast gain processing unit for generating an output pixel value according to the second contrast gain value and the input pixel value.

One embodiment of the invention provides a contrast control method. The contrast control method, applied to an image display system, comprises: calculating an average value and detecting a maximum value according to a plurality of pixels of a current image; determining a gain index and a brightness index according to the average value; generating a backlight control signal according to the brightness index; obtaining a first contrast gain value and a soft-clamping gain value according to the gain index, the average value and the maximum value; selecting one from the first contrast gain value and the soft-clamping gain value as a second contrast gain value according to an input pixel value of the current image; and, obtaining an output pixel value according to the second contrast gain value and the input pixel value.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

In the present disclosure, numerous specific details are provided, such as examples of electrical circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

According to the invention, in order to reduce power consumption, a backlight brightness is reduced and a contrast gain is compensated (or a display brightness is enhanced) at the same time. Accordingly, viewers are capable of enjoying the same image quality without perceiving distorted images. Since the power consumption of a backlight occupies the better part in a whole image display system, the total power consumption of the image display system is reduced according to the invention.

Figure 1:
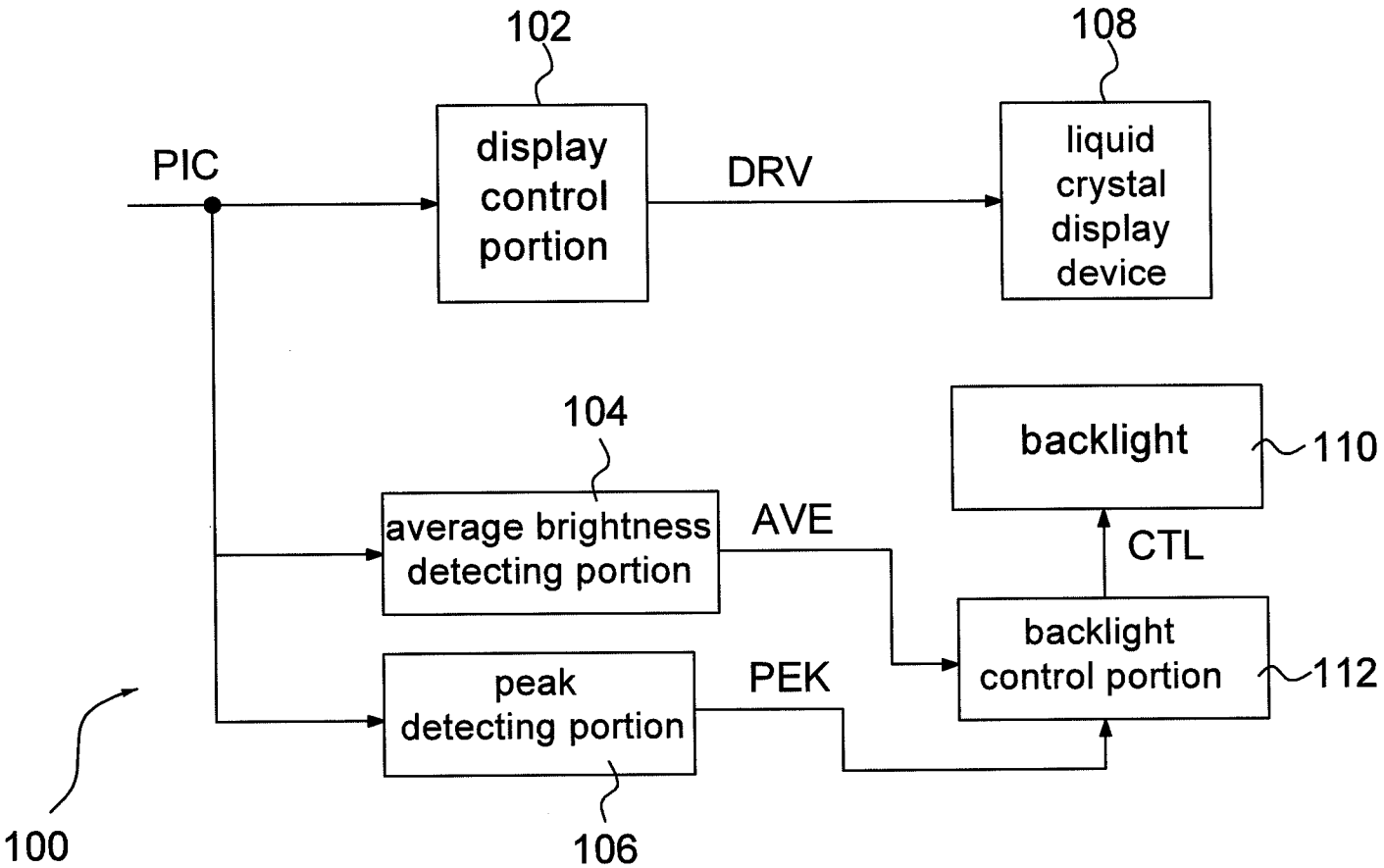
FIG. 1 (PRIOR ART)
FIG. 1 shows a block diagram of a conventional image display device.
Figure 2:
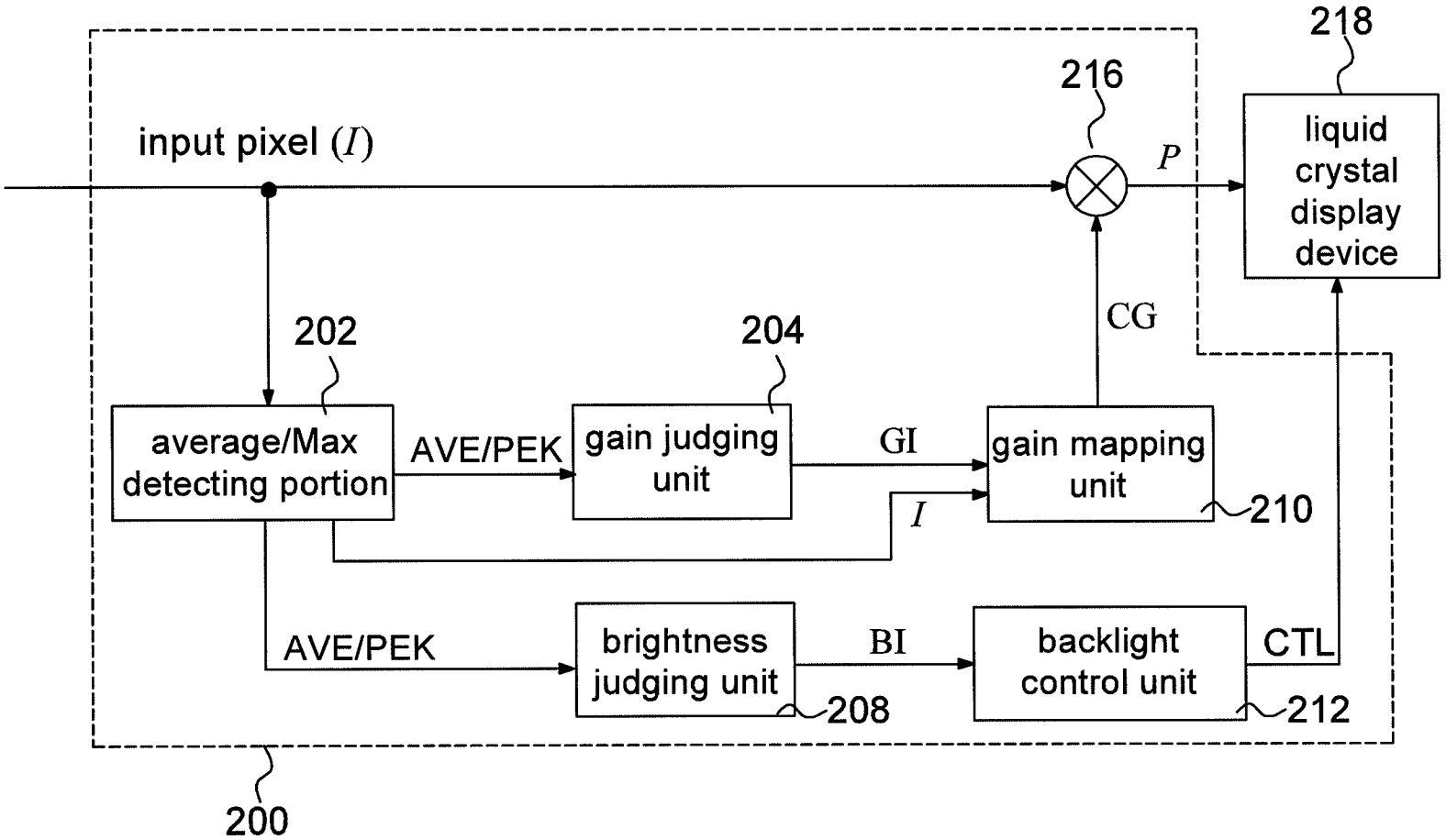
FIG. 2 shows a block diagram of a contrast control device according to one embodiment of the invention.

FIG. 2 shows a block diagram of a contrast control device according to one embodiment of the invention. Referring to FIG. 2, a contrast control device 200 of the invention, applied to an image display system, includes an average/maximum detecting unit 202, a gain judging unit 204, a brightness judging unit 208, a gain mapping unit 210, a backlight source control unit 212 and a contrast gain processing unit 216.

After receiving an input image (e.g. a frame or a field), the average/maximum detecting unit 202 calculates an average (AVE) value and detects a maximum (PEK) value according to luminance values and/or chrominance values of the pixels (I) in the input image. According to the AVE value, the gain judging unit 204 generates a corresponding gain index (GI) value while the brightness judging unit 208 generates a corresponding brightness index (BI) value. According to the BI value, the backlight control unit 212 provides a control signal (CTL) to a backlight (not shown, embedded in the liquid crystal display device 218). Preferably, according to the BI index, the backlight control unit 212 reduces the duty cycles of a pulse width modulation (PWM) signal to reduce the brightness of the backlight. Those skilled in the art can calculate the power consumption of the backlight in view of the PWM duty cycle.

On the other hand, the gain mapping unit 210 generates a corresponding contrast gain (CG) value (i.e, the slope g in FIG. 3) according to the GI value. Then, the contrast gain processing unit 216 generates a corresponding output pixel value (P) according to an input pixel value (I) (e.g. its luminance value and/or chrominance value) and the CG value. In this embodiment, the contrast gain processing unit 216 is implemented using a multiplier. However, the specific details are intended to be illustrative, and not limitations of the invention. The multiplier 216 multiplies the input pixel value (I) (such as a luminance value or a chrominance value) by the CG value to obtain the output pixel value (P).

In this embodiment, based on different AVE values, the brightness judging unit 208 generates a corresponding BI value to reduce different backlight brightness and the gain judging unit 204 generates a corresponding GI value to enhance display brightness at the same time. Therefore, the power consumption can be reduced and the viewers do not perceive degraded image quality. In view of hardware cost, a limited number of sets of parameters (AVE/PEK/GI/BI), such as 20 sets of parameters, are provided for the system.

Figure 3:
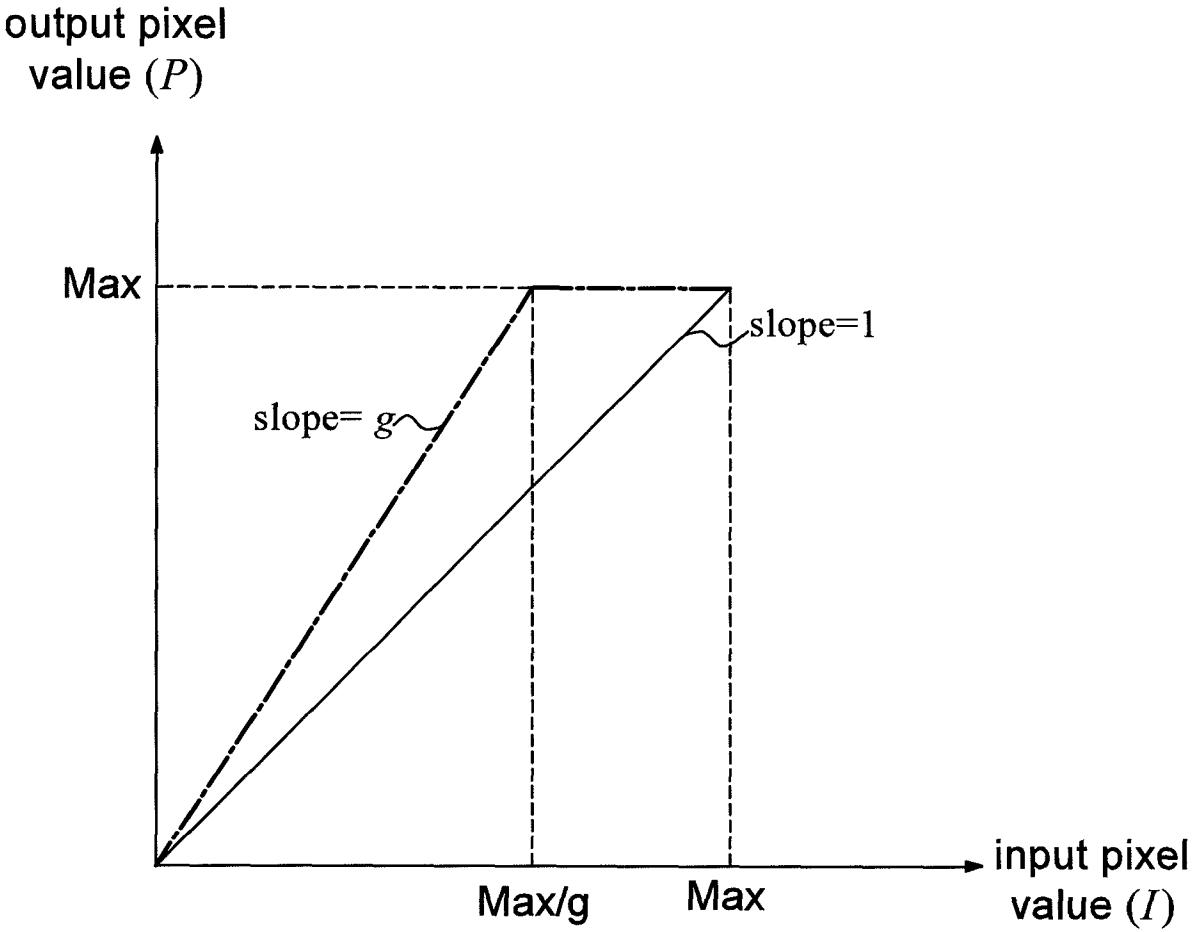
FIG. 3 shows output pixel values saturate at high luminance levels or/and high chrominance levels.

However, the output pixel value (P), generated by the multiplier 216, may be greater than a threshold value and saturated at high levels (including high luminance levels or/and high chrominance levels). In a case of 8-bit-per-pixel luminance data, the output pixel value (P) may be greater than level 255 and saturated at the white level (level 255). As shown in FIG. 3, when the CG value equals g (i.e. slope=g and g>1), the output pixel values (P), corresponding to the input pixel values (I) ranging from Max/g to Max, reach its saturation level (i.e. Max on Y axis), making the output pixel values (P) not distinguishable at high luminance levels.

In view of the problem, an alternative embodiment is provided and describes as follows.

Figure 4:
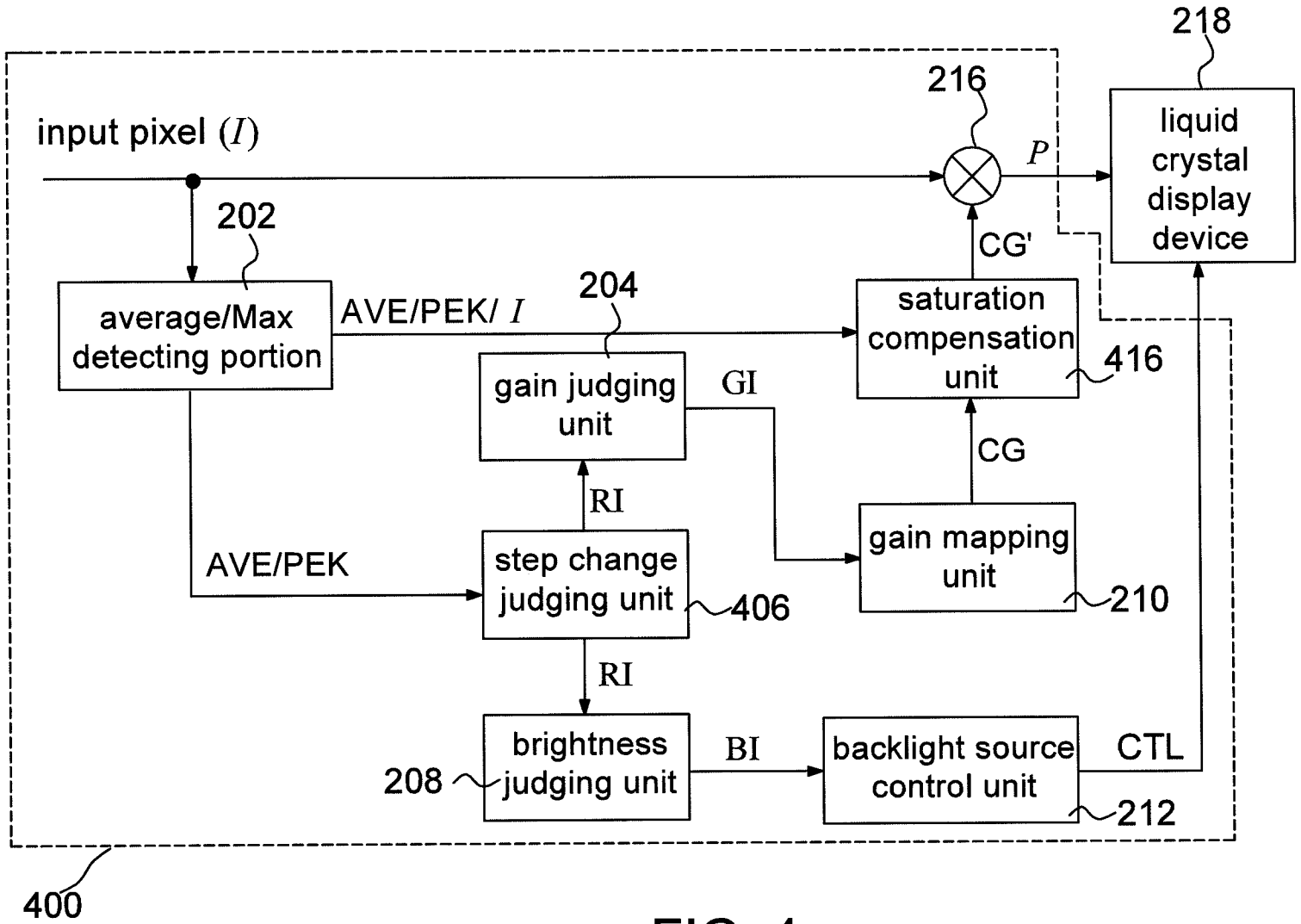
FIG. 4 shows a block diagram of a contrast control device according to another embodiment of the invention.

FIG. 4 shows a block diagram of a contrast control device according to another embodiment of the invention. Referring to FIG. 4, in this embodiment, modification is found in the addition of a step change judging unit 406 and a saturation compensation unit 416.

The step change judging unit 406 is provided for fast scene change applications. When there are fast-changing scenes in displayed images, a flicker phenomenon may occur since the BI and GI values vary rapidly. The step change judging unit 406 receives the AVE values from the average/maximum detecting unit 202, determines the AVE difference between the current image and the previous image, and finally supplies a corresponding reference index (RI) to the gain judging unit 204 and the brightness judging unit 208. It should be noted that the backlight brightness is normally adjusted once for each image. When there is a big change of scene from the input images (e.g. a big AVE difference between the current image and the previous image), instead of being precisely changed to a target value at a time, the RI value is adjusted in a step-by-step manner such that the BI and GI values are also adjusted step-by-step. For example, when there is a big change of scene from the input images, two approaches may be adopted as follows. First, in a series of consecutive images, the RI value is adjusted in a small-step manner for each image until the RI value reaches its target values. Secondly, in a series of consecutive images, the RI value is adjusted in a big-step manner for every other n (n is a positive integer) images until the RI value reaches its target values. Since the step change judging unit 406 adjusts the backlight brightness gradually and smoothly, the viewers do not perceive screen flicker.

Figure 5:
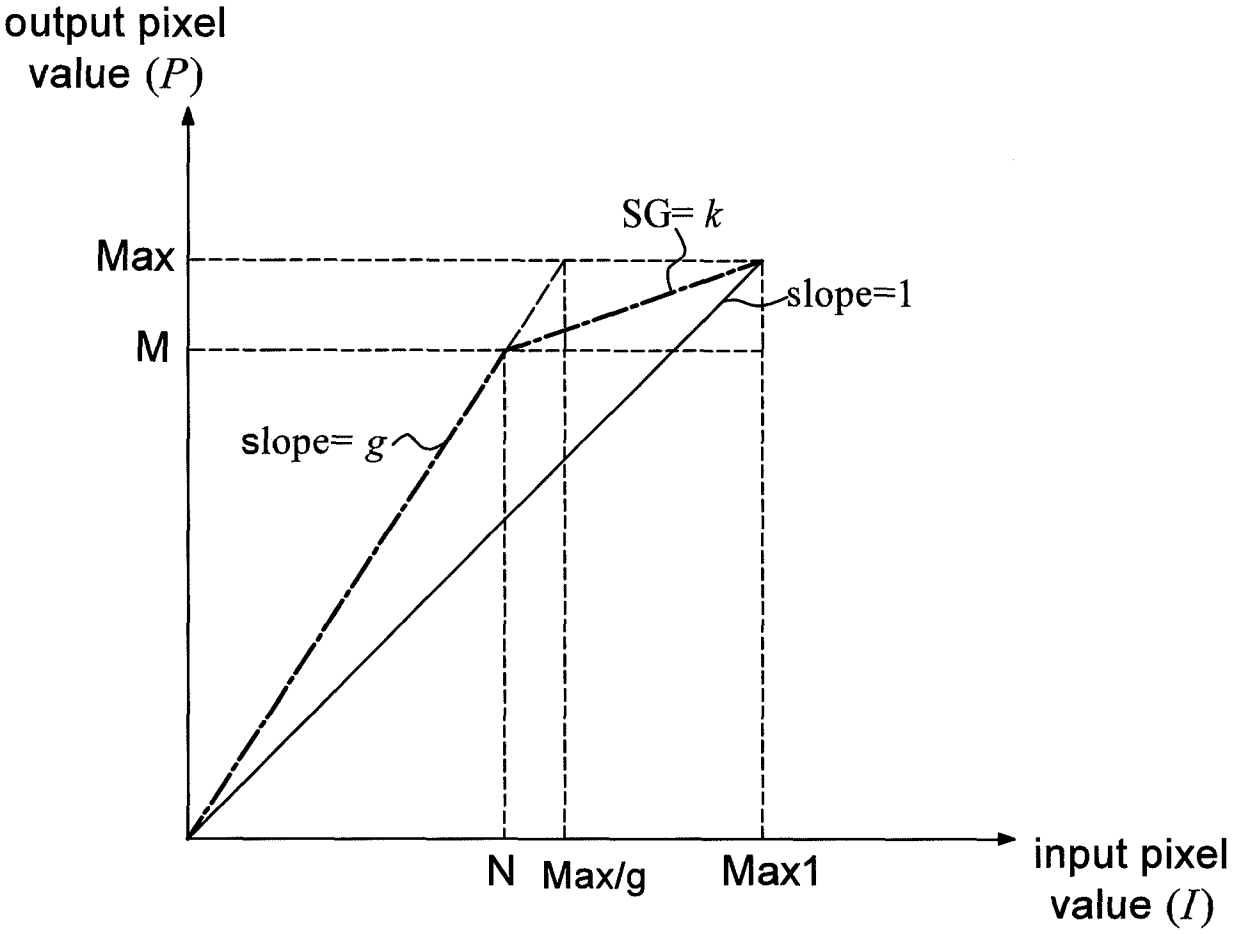
FIG. 5 shows a soft clamping mechanism of the invention.

The saturation compensation unit 416 of FIG. 4 includes a soft-clamping mechanism for reducing the CG values at high levels (including high luminance levels or/and high chrominance levels). In this embodiment, a resultant contrast gain value (CG') is determined by the AVE value and clamped by the saturation compensation unit 416. FIG. 5 shows a soft clamping mechanism of the invention. When an input pixel value (I) is greater than N, the CG' value is clamped to k (i.e., a soft clamping gain, (SG) equal to k, and 0<k<1) by the saturation compensation unit 416. Accordingly, after contrast processing (performed by the contrast gain processing unit 216), the output pixel values (P) at the high levels (their corresponding input pixel values (I) greater than N) are distinguishable and retain linearity. Please be noted that both of the g and k values are not fixed, but depend on the AVE value for each input image. Specifically, the g value is firstly determined by the AVE value. According to the g value and PEK value, the saturation compensation unit 416 can determine whether saturation will occur at the high levels (in other words, determine whether the output pixel values (P) will saturate at the high levels). If it is determined that saturation will occur at the high levels (for example, the PEK value is greater than Max/g), the saturation compensation unit 416 will apply a soft clamping gain (SG) to the high levels and determine an appropriate k value according to the AVE value. In this regard, the N and M positions in FIG. 5 are determined after the slopes g and k are settled.

On the other hand, the soft-clamping mechanism embedded in the saturation compensation unit 416 further includes an adaptive clamping gain adjustment mechanism. According to the AVE and PEK values, the saturation compensation unit 416 adaptively adjusts the soft clamping gain (SG). For image data with bright colors (e.g. sunshine), the soft clamping gain (SG) will be further adjusted and therefore the image contrast at the high levels will be further enhanced. According to one embodiment, the following equations are provided for the saturation compensation unit 416 to determine whether to conduct the adaptive clamping gain adjustment.

```
If (PEK>TH_Max and AVE> TH_AVE)
   SG=m×k;
else
   SG=k;
```

Figure 6:
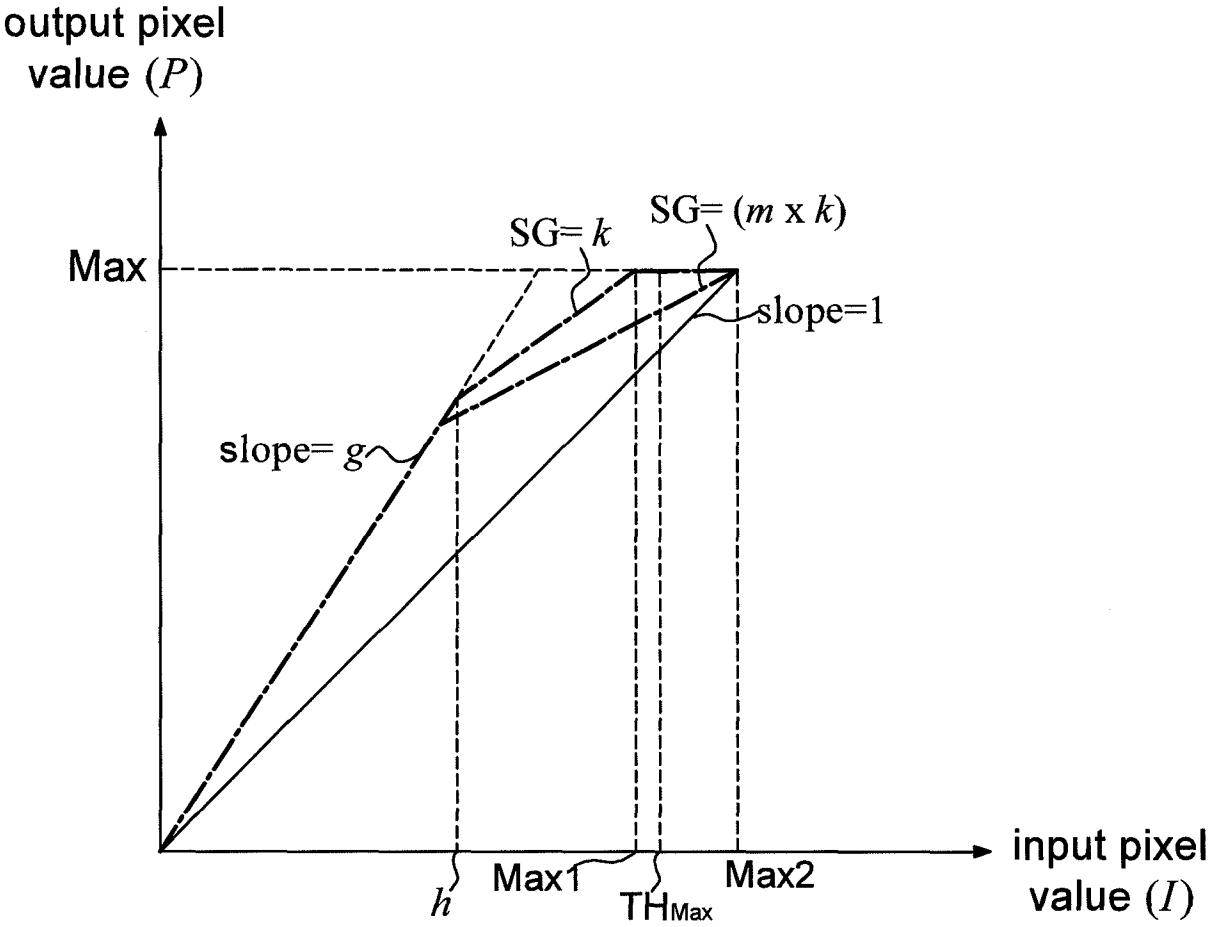
FIG. 6 shows an adaptive clamping gain adjustment mechanism of the invention.
Figure 7:
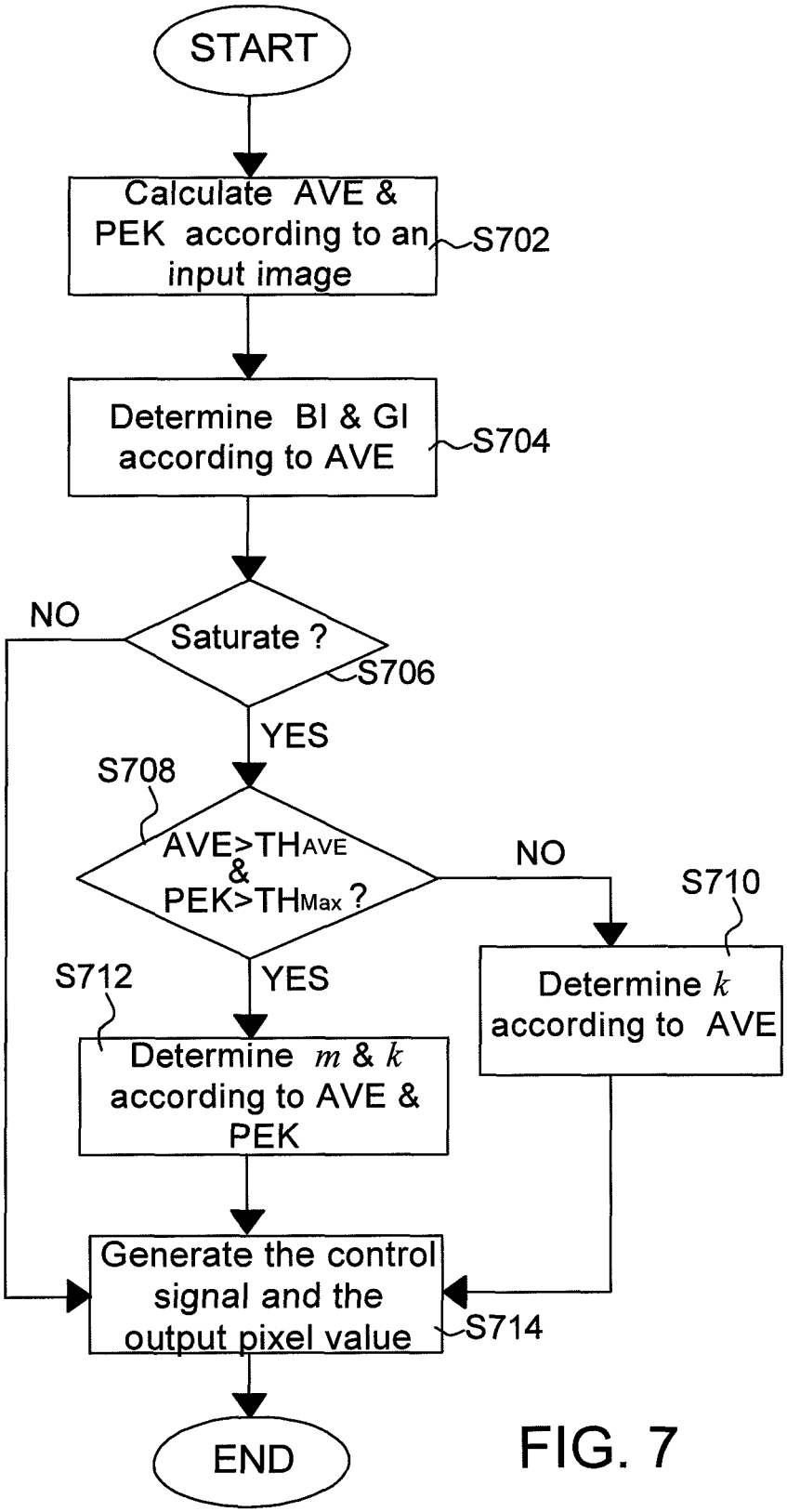
FIG. 7 shows a flow chart of a contrast control method according to an embodiment of the invention.

FIG. 6 shows an adaptive clamping gain adjustment mechanism of the invention. When an image is characterized by bright colors (i.e., $AVE>TH_{AVE}$ and $PEK>TH_{Max}$), based on the adaptive clamping gain adjustment mechanism, the saturation compensation unit 416 sets the soft clamping gain (SG) to (m×k) in order to further enhancing the image contrast at the high levels. Otherwise, the saturation compensation unit 416 still sets the soft clamping gain (SG) to the k value. Finally, according to an input pixel value (I), the saturation compensation unit 416 selects one from the g value and the soft-clamping gain (SG) for output as the resultant contrast gain value (CG'). Accordingly, the multiplier 216 multiplies the input pixel value (I) by the CG' value to obtain the output pixel value (P). Referring to FIG. 6, in one embodiment, if the input pixel value (I) is greater than or equal to the h value, the saturation compensation unit 416 selects the soft-clamping gain (SG) for output as the CG' value. Otherwise, the saturation compensation unit 416 selects the g value for output as the CG' value. p FIG. 7 shows a flow chart of a contrast control method according to an embodiment of the invention. Referring to FIG. 7, the contrast control method of the invention is applied to an image display system, such as a liquid crystal display device. However, the invention is not limited to the above described examples. The contrast control method of the invention is described as follows.

Step S702: Calculate an average value (AVE) and detect a maximum value (PEK) according to a plurality of pixels of a current image.

Step S704: Determine a gain index and a brightness index according to the AVE value. As mentioned above, according to the AVE value, the brightness judging unit 208 generates a corresponding bright index BI to reduce different backlight brightness. Meanwhile, the gain judging unit 204 generates a corresponding gain index (GI) to enhance image brightness. Thus, the viewers perceive the same image quality and the power consumption is saved as well. In this embodiment, if the GI value is determined, the g value of the slope is also determined.

Step S706: Determine whether the output pixel value (P) will saturate at the high levels (including high luminance levels or/and high chrominance levels). For example, according to the g value of the slope and the PEK value, the saturation compensation unit 416 can determine whether the output pixel value (P) will saturate at the high levels (in other words, determine whether saturation will occur at the high levels). If "YES," the flow goes to the step S708; otherwise, the flow goes to the step S714.

Step S708: Determine whether the AVE value is greater than $TH_{AVE}$ and the PEK value is greater than $TH_{MAX}$. If "YES," the flow goes to the step S712; otherwise, the flow goes to the step S710.

Step S710: Determine the k value according to the AVE value. Besides, set the soft clamping gain (SG) to the k value and the flow goes to the step S714.

Step S712: Determine the m and k values according to the AVE value and the PEK value. Besides, set the soft clamping gain (SG) to (m×k), i.e., SG=m×k Step S714: Generate a control signal (CTL) to adjust a backlight brightness in accordance with the brightness index (BI). Meanwhile, one of the g value and the soft-clamping gain (SG) is selected as a resultant contrast gain value (CG'). Accordingly, the input pixel value (I) is multiplied by the CG' value to obtain the output pixel value (P).

While certain exemplary embodiments have been described and shown in the accompanying drawings, it is to be understood that such embodiments are merely illustrative of and not restrictive on the broad invention, and that this invention should not be limited to the specific construction and arrangement shown and described, since various other modifications may occur to those ordinarily skilled in the art.

What is claimed is:

1. A contrast control device, comprising:

a detecting unit, for calculating an average value and detecting a maximum value according to a plurality of pixels of a current image;

a judging unit, for generating a gain index and a brightness index according to the average value;

a backlight control unit, for generating a backlight control signal according to the brightness index;

a gain generating unit, coupled to the detecting unit, for generating a first contrast gain value and a soft-clamping gain value according to the gain index, the average value and the maximum value and for selecting one from the first contrast gain value and the soft-clamping gain value for output as a second contrast gain value according to an input pixel value of the current image; and a contrast gain processing unit, for generating an output pixel value according to the second contrast gain value and the input pixel value;

wherein the gain generating unit comprises:

a gain mapping unit, for generating the first contrast gain value according to the gain index, wherein the first contrast gain value is greater than 1; and a saturation compensation unit, coupled to the gain mapping unit, for selecting one from the first contrast gain value and the soft-clamping gain value for output as the second contrast gain value according to the input pixel value, wherein the saturation compensation unit sets the soft-clamping gain value to (m×k) when the average value is greater than a first threshold value and the maximum value is greater than a second threshold value, otherwise the saturation compensation unit sets the soft-clamping gain value to k, and wherein 0<m, k<1 and the m and k values depend on at least one of the average value and the maximum value.

2. The device according to claim 1, wherein the detecting unit calculates the average value and detects the maximum value according to at least one of luminance values and chrominance values of the plurality of pixels of the current image.

3. The device according to claim 1, wherein when the saturation compensation unit determines that no saturation occurs according to the first contrast gain value and the maximum value, the saturation compensation unit selects the first contrast gain value for output as the second contrast gain value.

4. The device according to claim 1, wherein when the gain generating unit determines that no saturation occurs according to the first contrast gain value and the maximum value, the gain generating unit selects the first contrast gain value for output as the second contrast gain value.

5. The device according to claim 1, wherein the judging unit comprises:

a step change judging unit, being coupled to the detecting unit for adjusting a reference index in a step-by-step manner according to a difference between the average value of the current image and an average value of a previous image;

a gain judging unit, for generating the gain index according to the reference index; and a brightness judging unit, for generating the brightness index according to the reference index.

6. The device according to claim 1, wherein the backlight control signal is a pulse width modulation signal, and wherein the backlight control unit adjusts a duty cycle of the pulse width modulation signal according to the brightness index.

7. The device according to claim 1, wherein the contrast gain processing unit is implemented by using a multiplier.

8. A contrast control method, applied to an image display system, the method comprising:

calculating an average value and detecting a maximum value according to a plurality of pixels of a current image;

determining a gain index and a brightness index according to the average value;

generating a backlight control signal according to the brightness index;

obtaining a first contrast gain value and a soft-clamping gain value according to the gain index, the average value and the maximum value;

selecting one from the first contrast gain value and the soft-clamping gain value as a second contrast gain value according to an input pixel value of the current image; and obtaining an output pixel value according to the second contrast gain value and the input pixel value;

wherein the step of obtaining the first contrast gain value and the soft-clamping gain value comprises:

determining the first contrast gain value according to the gain index, wherein the first contrast gain value is greater than 1;

determining whether saturation occurs according to the first contrast gain value and the maximum value; and setting the soft-clamping gain value to (m×k) when saturation occurs and the average value is greater than a first threshold value and the maximum value is greater than a second threshold value, otherwise setting the soft-clamping gain value to k ;

wherein $0<m$, $k<1$ and the m and k values depend on at least one of the average value and the maximum value.

9. The method according to claim 8, wherein the step of determining the gain index and the brightness index comprises:

adjusting a reference index in a step-by-step manner according to a difference between the average value of the current image and an average value of a previous image; and obtaining the gain index and the brightness index according to the reference index.

10. The method according to claim 8, wherein the step of calculating and detecting comprises:

calculating the average value and detecting the maximum value according to at least one of luminance values and chrominance values of the plurality of pixels of the current image.

11. The method according to claim 8, wherein the backlight control signal is a pulse width modulation signal, and wherein the backlight control unit adjusts a duty cycle of the pulse width modulation signal according to the brightness index.

12. The method according to claim 8, wherein the step of obtaining the output pixel value comprises:

obtaining the output pixel value by multiplying the second contrast gain value by the input pixel value.

* * * * *